US011771137B2

(12) United States Patent
Liu et al.

(10) Patent No.: US 11,771,137 B2
(45) Date of Patent: Oct. 3, 2023

(54) FREQUENCY TRACKING METHOD FOR ULTRASONIC ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Zuoxiong Zou, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 551 days.

(21) Appl. No.: 17/251,726

(22) PCT Filed: Jun. 12, 2019

(86) PCT No.: PCT/CN2019/090891
§ 371 (c)(1),
(2) Date: Dec. 11, 2020

(87) PCT Pub. No.: WO2019/238062
PCT Pub. Date: Dec. 19, 2019

(65) Prior Publication Data

US 2021/0127749 A1 May 6, 2021

(30) Foreign Application Priority Data

Jun. 14, 2018 (CN) ..... 201810612754.0

(51) Int. Cl.
*A24F 40/53* (2020.01)
*A24F 40/05* (2020.01)
*B05B 17/06* (2006.01)

(52) U.S. Cl.
CPC ..... *A24F 40/53* (2020.01); *A24F 40/05* (2020.01); *B05B 17/0653* (2013.01)

(58) Field of Classification Search
None
See application file for complete search history.

(56) References Cited

U.S. PATENT DOCUMENTS 6,402,046 B1 * 6/2002 Loser ..... B05B 17/0669 239/102.1
11,717,623 B2 * 8/2023 Lahoud ..... A24F 40/10 128/200.14

(Continued)

FOREIGN PATENT DOCUMENTS

CN 105661649 A 6/2016
CN 105763098 A 7/2016

(Continued)

OTHER PUBLICATIONS

International Search Report issued in International Application No. PCT/CN2019/090891 dated Aug. 30, 2019, 3 pages.

*Primary Examiner* — James Harvey
(74) *Attorney, Agent, or Firm* — Mauriel Kapouytian Woods LLP; Ran Pang; Michael Mauriel

(57) ABSTRACT

A frequency tracking method for an ultrasonic electronic cigarette is provided. The method includes enabling start of working of an ultrasonic atomizer and selecting an oscillation frequency range of the ultrasonic atomizer as a frequency scan range according to the natural frequency characteristics of the ultrasonic atomizer. The method further includes selecting N frequency points within the frequency scan range and controlling the ultrasonic atomizer to work at the N frequency points. The method further includes finding out a maximum current value Imax and a minimum current value Imin of the ultrasonic atomizer when working at the N frequency points, and finding out a working frequency fimax (Continued)

corresponding to the maximum current value Imax. The method further includes controlling the ultrasonic atomizer to work at a frequency $f_{tracking}$=fimax+Δf; and detecting the working current I of the ultrasonic atomizer.

7 Claims, 1 Drawing Sheet

(56) References Cited

U.S. PATENT DOCUMENTS

| | | | | |
|---|---|---|---|---|
| 2020/0037402 | A1* | 1/2020 | Abi Aoun | A24F 40/465 |
| 2021/0127749 | A1* | 5/2021 | Liu | B05B 17/0669 |

FOREIGN PATENT DOCUMENTS

| | | | |
|---|---|---|---|
| CN | 105772312 | A | 7/2016 |
| CN | 207020508 | U | 2/2018 |
| CN | 207179901 | U | 4/2018 |
| CN | 207383536 | U | 5/2018 |
| JP | 2001069963 | A | 3/2001 |

* cited by examiner

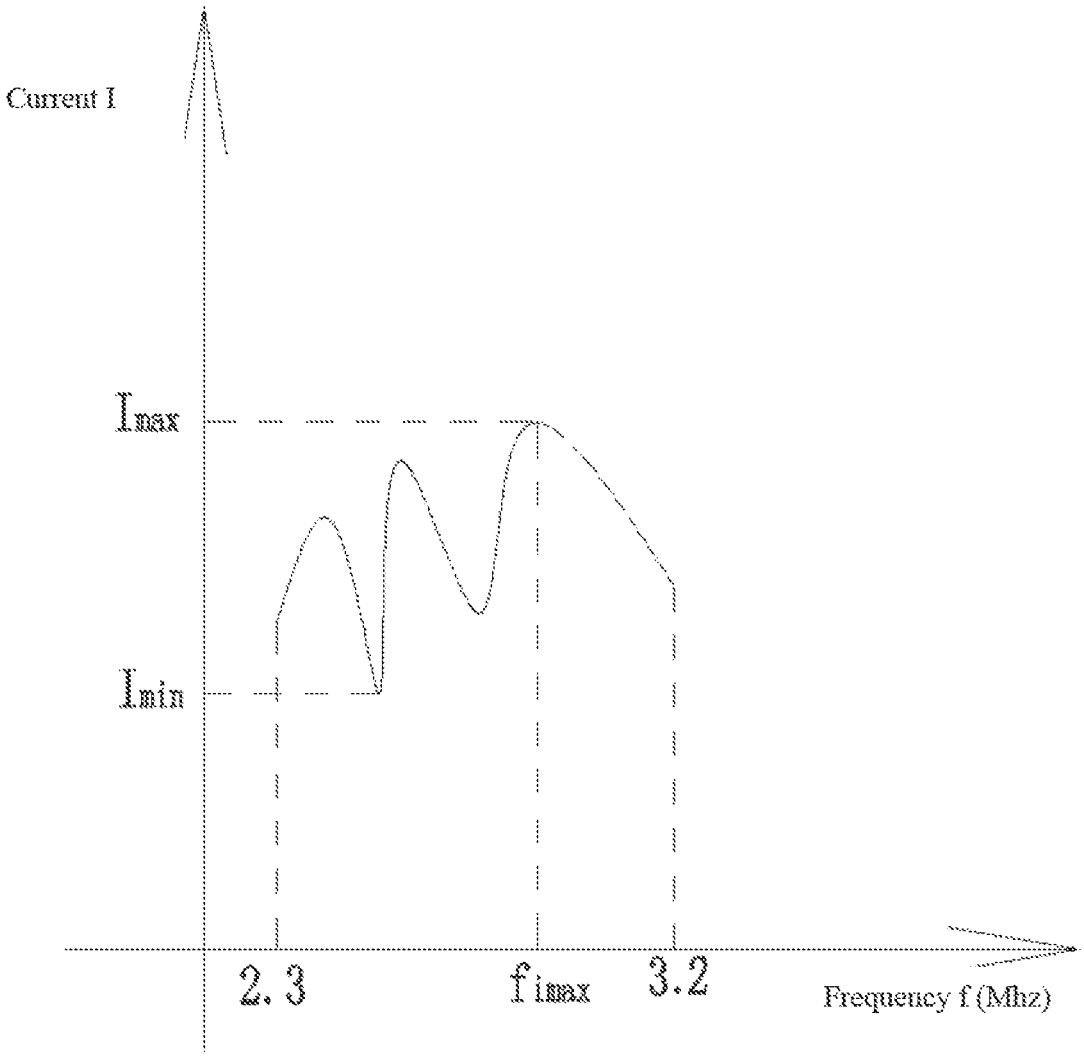
Current I
Imax
Imin
2.3
fimax
3.2
Frequency f (Mhz)

FREQUENCY TRACKING METHOD FOR ULTRASONIC ELECTRONIC CIGARETTE

CROSS REFERENCE TO RELATED APPLICATIONS

This application is a U.S. National Phase application under 35 U.S.C. § 371 of International Application No. PCT/CN2019/090891 filed on Jun. 12, 2019, which claims priority to Chinese Application No. 201810612754.0 filed on Jun. 14, 2018. The entire contents of these applications are hereby incorporated herein by reference.

FIELD OF THE INVENTION

The present invention belongs to the technical field of ultrasonic electronic cigarettes, and particularly relates to a frequency tracking method for an ultrasonic electronic cigarette.

BACKGROUND OF THE INVENTION

The existing frequency tracking methods for ultrasonic electronic cigarettes are to detect the working current of an ultrasonic atomizer and then to find a maximum current in the detection period, and a control module controls the operation of the ultrasonic atomizer with an oscillation frequency of the ultrasonic atomizer corresponding to the maximum current as an optimal frequency.

In practical applications, since the optimal frequency of the ultrasonic atomizer changes constantly during the working process, the optimal frequency detected may not be the real-time optimal frequency of the ultrasonic atomizer, so that the frequency tracking is inaccurate, and it is difficult to obtain an optimal atomization effect. When the optimal frequency obtained during the frequency tracking process is close to the real-time optimal frequency, the amount of smoke of the ultrasonic atomizer is large, otherwise the amount of smoke of the ultrasonic atomizer is small, so the smoke for a user during smoking is unstable, and the user experience is poor.

SUMMARY OF THE INVENTION

In the prior art, as the oscillation frequency of the ultrasonic atomizer corresponding to the maximum current in the detection period is used as the optimal oscillation frequency, the frequency tracking effect is inaccurate and the atomization effect is poor. The objective of the present invention is to provide, against the above shortcomings of the prior art, a frequency tracking method for an ultrasonic electronic cigarette, which can achieve accurate frequency tracking, high atomization efficiency, large and stable smoke amount and good user experience.

In order to solve the above technical problems, the technical solution adopted by the present invention is:

A frequency tracking method for an ultrasonic electronic cigarette, comprising:

step A, enabling start of working of an ultrasonic atomizer:

the method further comprising the following steps:

step B, selecting an oscillation frequency range of the ultrasonic atomizer as a frequency scan range [fmin, fmax] according to the natural frequency characteristics of the ultrasonic atomizer, selecting N frequency points within the frequency scan range, controlling the ultrasonic atomizer to work respectively at the N frequency points, finding out a maximum current value Imax and a minimum current value Imin of the ultrasonic atomizer when working at the N frequency points, and finding out a working frequency fimax of the ultrasonic atomizer corresponding to the maximum current value Imax;

step C, controlling the ultrasonic atomizer to work at a frequency $f_{tracking}$=fimax+Δf, wherein Δf is a set step value:

step D, detecting the working current I of the ultrasonic atomizer, and if Imin≤I≤Imax, skipping to step C; otherwise, updating fimax to original fimax plus Δf, and skipping to step E;

step E, if the updated fimax value is within the frequency scan range [fmin, fmax], skipping to step C; otherwise, skipping to step F; and step F, controlling the ultrasonic atomizer to work at the frequency fimax, and skipping to step D;

wherein in any one of steps B to F, if the ultrasonic atomizer stops working, the frequency tracking process for the ultrasonic electronic cigarette ends.

With the above method, the above-mentioned frequency tracking process is executed every time the ultrasonic electronic cigarette is activated. The method of the present invention performs continuous and cyclic frequency tracking according to the current detection and the comparison results of current and frequency, so that the working frequency of the ultrasonic atomizer is constantly close to the optimal frequency in real time, accurate frequency tracking is achieved, the atomization efficiency of the ultrasonic atomizer is high, the amount of smoke is large and stable, and the user experience is good.

As a preferred mode, the frequency scan range [fmin, fmax] is [2.3 MHZ, 3.2 MHZ].

As a preferred mode, the value range of N is 10 to 80.

As a preferred mode, the value range of N is 35 to 45.

As a preferred mode, the value range of Δf is 3 KHZ to 8 KHZ.

As a preferred mode, the value range of Δf is 5 KHZ to 6 KHZ.

As a preferred mode, step B is completed within 1 to 5 ms after start of working of the ultrasonic atomizer.

Compared with the prior art, the present invention can achieve accurate frequency tracking of the ultrasonic atomizer, high atomization efficiency, large and stable smoke amount, and good user experience.

BRIEF DESCRIPTION OF THE DRAWING

FIG. 1 is a frequency-current curve chart corresponding to a frequency sweep phase of an ultrasonic atomizer.

DETAILED DESCRIPTION OF EMBODIMENTS

A frequency tracking method for an ultrasonic electronic cigarette comprises the following steps:

Step A, an ultrasonic atomizer starts to work.

Step B, an oscillation frequency range of the ultrasonic atomizer is selected as a frequency scan range [fmin, fmax] according to the natural frequency characteristics of the ultrasonic atomizer, N frequency points are selected within the frequency scan range, the ultrasonic atomizer is controlled to work respectively at the N frequency points, a maximum current value Imax and a minimum current value Imin of the ultrasonic atomizer when working at the N frequency points are found out, and a working frequency fimax of the ultrasonic atomizer corresponding to the maximum current value Imax is found out.

The frequency scan range [fmin, fmax] is [2.3 MHZ, 3.2 MHZ].

The value range of N is preferably 10 to 80. The value range of N is more preferably 35 to 45.

The value range of Δf is preferably 3 to 8 KHZ. The value range of Δf is more preferably 5 to 6 KHZ.

Step B is completed within 1 to 5 ms after start of working of the ultrasonic atomizer. As shown in FIG. 1, in a frequency sweep phase of step B, the minimum frequency and the maximum frequency do not necessarily correspond to the minimum current and the maximum current. It can be seen from FIG. 1 that the frequency fimax obtained by frequency sweep is defaulted as a frequency point with better atomization effect.

Step C, the ultrasonic atomizer is controlled to work at a frequency $f_{tracking}$=fimax+Δf, wherein Δf is a set step value.

Step D, the working current I of the ultrasonic atomizer is detected, and if Imin≤I≤Imax, step C is skipped; otherwise, fimax is updated to original fimax plus Δf, and step E is skipped.

Step E, if value of the updated fimax is within the frequency scan range [fmin, fmax], step C is skipped; otherwise, step F is skipped.

Step F, the ultrasonic atomizer is controlled to work at the frequency fimax, and step D is skipped.

In any one of steps B to F, if the ultrasonic atomizer stops working, the frequency tracking process for the ultrasonic electronic cigarette ends.

The above-mentioned frequency tracking process is executed every time the ultrasonic electronic cigarette is activated. The present invention executes continuous and cyclic frequency tracking based on the current detection result, the current comparison result and the frequency comparison result. So that the working frequency of the ultrasonic atomizer is constantly close to the optimal frequency in real time, accurate frequency tracking is achieved, the atomization efficiency of the ultrasonic atomizer is high, the amount of smoke is large and stable, and the user experience is good.

The embodiments of the present invention are described above with reference to the drawings, but the present invention is not limited to the specific embodiments. The specific embodiments described above are merely illustrative but not limited. Many forms may also be made by those of ordinary skill in the art under the enlightenment of the present invention without departing from the purpose of the present invention and the scope of the claims, and all these forms fall into the scope of the present invention.

The invention claimed is:

1. A frequency tracking method for an ultrasonic electronic cigarette, comprising:

step A, enabling start of working of an ultrasonic atomizer;

step B, selecting an oscillation frequency range of the ultrasonic atomizer as a frequency scan range [fmin, fmax] according to natural frequency characteristics of the ultrasonic atomizer, selecting N frequency points within the frequency scan range, controlling the ultrasonic atomizer to work respectively at the N frequency points, finding out a maximum current value Imax and a minimum current value Imin of the ultrasonic atomizer when working at the N frequency points, and finding out a working frequency fimax of the ultrasonic atomizer corresponding to the maximum current value Imax;

step C, controlling the ultrasonic atomizer to work at a frequency $f_{tracking}$=fimax+Δf, wherein Δf is a set step value;

step D, detecting the working current I of the ultrasonic atomizer, and if Imin≤I≤Imax, skipping to step C;

otherwise, updating fimax to original fimax plus Δf, and skipping to step E;

step E, if the updated fimax value is within the frequency scan range [fmin, fmax], skipping to step C;

otherwise, skipping to step F; and step F, controlling the ultrasonic atomizer to work at the frequency fimax, and skipping to step D;

wherein in any one of steps B to F, if the ultrasonic atomizer stops working, the frequency tracking process for the ultrasonic electronic cigarette ends.

2. The frequency tracking method for an ultrasonic electronic cigarette according to claim 1, wherein the frequency scan range [fmin, fmax] is [2.3 MHZ, 3.2 MHZ].

3. The frequency tracking method for an ultrasonic electronic cigarette according to claim 1, wherein the value range of N is 10 to 80.

4. The frequency tracking method for an ultrasonic electronic cigarette according to claim 3, wherein the value range of N is 35 to 45.

5. The frequency tracking method for an ultrasonic electronic cigarette according to claim 1, wherein the value range of Δf is 3 KHZ to 8 KHZ.

6. The frequency tracking method for an ultrasonic electronic cigarette according to claim 5, wherein the value range of Δf is 5 KHZ to 6 KHZ.

7. The frequency tracking method for an ultrasonic electronic cigarette according to claim 1, wherein step B is completed within 1 to 5 ms after start of working of the ultrasonic atomizer.

* * * * *